US006641185B2

(12) United States Patent
Hale et al.

(10) Patent No.: US 6,641,185 B2
(45) Date of Patent: Nov. 4, 2003

(54) DOOR LOCK HAVING U-BAR AND CUSTOM STRIKER PLATE

(76) Inventors: Daniel Hale, 12841 Longden St., Garden Grove, CA (US) 92841; Ross Gunn, P.O. Box 2418, Newport Beach, CA (US) 92659

( * ) Notice: Subject to any disclaimer, the term of this patent is extended or adjusted under 35 U.S.C. 154(b) by 0 days.

(21) Appl. No.: 10/329,901

(22) Filed: Dec. 26, 2002

(65) Prior Publication Data

US 2003/0127867 A1 Jul. 10, 2003

Related U.S. Application Data

(60) Provisional application No. 60/346,659, filed on Jan. 8, 2002.

(51) Int. Cl.[7] ..... E05C 19/18
(52) U.S. Cl. ..... 292/289; 292/292; 292/295
(58) Field of Search ..... 292/288, 289, 292/292, 295, DIG. 2

(56) References Cited

U.S. PATENT DOCUMENTS 720,496 A * 2/1903 Simpson
1,239,802 A * 9/1917 Macbeth
1,571,024 A * 1/1926 Scheid
2,536,352 A * 1/1951 Butcher ..... 292/148
3,731,965 A * 5/1973 Adkinson ..... 292/292
3,886,771 A * 6/1975 Robins ..... 70/90
4,004,833 A * 1/1977 Hull ..... 292/288
4,155,578 A * 5/1979 Rolland ..... 292/292
4,575,140 A * 3/1986 Dargis ..... 292/288
4,605,251 A * 8/1986 Finlay ..... 292/288
5,007,263 A * 4/1991 Taylor ..... 70/416
5,360,245 A * 11/1994 David et al. ..... 292/289
5,664,815 A * 9/1997 Kornder ..... 292/288
5,709,422 A * 1/1998 Malone ..... 292/288
5,775,149 A * 7/1998 Small ..... 70/416

* cited by examiner

*Primary Examiner*—Gary Estremsky

(57) ABSTRACT

A door locking apparatus for use on a door and an associated door jamb is provided. The door locking apparatus includes a custom striker plate and a U-shaped element or U-Bar. The U-shaped element has two arm portions and the custom striker plate has two arm receiving apertures for receiving the arm portions of the U-shaped element. The U-shaped element partially encircles the shank of a door knob assembly and the two arm portions fit into the two arm receiving apertures to lock the door. A device for keeping the U-shaped element in a locked position is built into the U-shaped element. A preferred embodiment utilizes a notch on the U-shaped element to keep the device in a locked position.

20 Claims, 2 Drawing Sheets

DOOR LOCK HAVING U-BAR AND CUSTOM STRIKER PLATE

This application claims priority to U.S. Provisional Application No. 60/346,659 filed on Jan. 8, 2002 which for purposes of disclosure is incorporated herein by specific reference.

BACKGROUND OF THE INVENTION

This invention relates to devices that are attachable to doors that prevent that door from being opened.

PRIOR ART

Most hinged doors have a door knob assembly which includes a door knob on both sides of the door with a shank running through the door connecting the two knobs. The door knob assembly also includes a tumbler mechanism and a bolt that interacts with the door jamb to keep the door closed. A striker plate is usually mounted on the face of the door jamb designed to interact with the bolt. The striker plate has an aperture which holds the bolt when the door is in the closed position. Some times a locking mechanism is incorporated into the door knob assembly. Some times a locking mechanism is not incorporated into the door knob assembly.

Most exterior doors include one or more of a variety of key operated locks to prevent unauthorized entry. Some interior doors have some type of locks.

There are a wide variety of designs of door locks.

There are locks that can be built into the doors and door jambs. An example of this type of lock would be a lock associated with the door knobs. Deadbolts are also built into doors and door jambs.

There are also locking mechanisms that would be considered "add on devices" or auxiliary door locks. Some of the add on devices would be considered permanent features of the doors. This type would be chain locks and slider locks that could be installed on the inside of a door.

There are also "add on" locking mechanisms or locks devices would not necessarily be considered permanent features of the doors. These locking devices could be easily removed if so desired.

Other auxiliary door locks would be actually be a portable locking device. Some could be used when traveling for example in hotel or motel rooms to provide extra security.

It should be understood that these door locking devices could be used individually and in various combinations.

The "Door Lock" described in U.S. Pat. No. 4,605,251 awarded to Flinlay is similar to the device disclosed herein however the U.S. Pat. No. 4,605,251 has several shortcomings. The Finley device would be rather awkward to use. It appears that every time the device is placed into the locked position the "keepers" have to be moved one way or the other. The keepers supposedly keep the two ends of the U-bolt from slipping out of the apertures of the striker plate when an unauthorized entry is attempted. There are numerous problems that would be associated with the disclosed "keepers." It would be very difficult to provide the correct fit between the keepers and the shank of the "U-bolt". If the fit is too tight, it may be almost impossible to move them along the shank. Also, if the fit is too loose the keepers would fall off. Additionally, if the keepers were made of plastic material the plastic may shrink and make them almost impossible to move. Also plastic properties change over time which may cause them to crack or deteriorate. Additionally, plastic properties change with different environmental conditions.

Changes in temperature and humidity may cause plastic keepers to perform different than intended. The plastic keepers would expand and contract at a different rate than the metal u-bolt which definitely would affect the fit between the keepers and the shank. Additionally, having to deal with the keepers every time the U.S. Pat. No. 4,605,251 device were used to lock a door could be very time consuming. This could cause dangerous time delays if the door must be locked or unlocked in an emergency situation. Additionally, the keepers would ad extra cost for materials and assembly that would have to be factored into the selling price when the U.S. Pat. No. 4,605,251 device is marketed. If the strike plate with 4 screw holes and 4 screws were sold as shown in the U.S. Pat. No. 4,605,251 disclosure, four new holes would have to be drilled into the door jamb. This would be very labor intensive. This would require a drill which many consumers may not own. Also the ability to use a drill properly may be beyond the skills of many consumers. Some one may have to be hired to install the U.S. Pat. No. 4,605,251 strike plate properly. This would add additional cost for anyone that may want to install and use that locking device.

SUMMARY AND OBJECTS OF THE INVENTION

It is an object of this invention to provide a door lock device which would eliminate and/or limit unauthorized or forcible entries through that door.

It is an object of this invention to provide a door locking device that could be easily added to a door that already has a lock thereby giving extra security and preventing that door from being opened.

It is an object of this invention to provide a door locking device that could be easily added to a door that does not have any lock thereby giving that door security and preventing that door from being opened.

Another object of the present invention is to provide a door lock that is easy to understand and easy to operate.

Another object of the present invention is to provide a door lock that operates without a key.

A further object of the present invention is to provide a door lock that could be quickly placed into the locked position in the case of an emergency.

A further object of the present invention is to provide a door lock that could be quickly removed from the locked position in the case of an emergency.

It is a further object of the present invention to provide a door locking device which is of durable and reliable construction and would be rugged. It would be rather difficult to break the parts during an attempted forced entry.

It is an object of this invention to provide a door lock device that would even prevent an intruder with a master key from gaining unauthorized entry through the door.

It is an object of this invention to provide a door lock device that will create a sound that could be heard if a forced entry is attempted; thereby alerting the person inside the room.

It is an object of this invention to provide a door locking device that could be installed easily by almost anyone.

It is an object of this invention to provide a door locking device that requires no special tools for installation. All that would be required would be a screwdriver.

It is an object of this invention to provide a door lock device that does not structurally alter the door or door jam when installed. Renters would not need special permission to install the device.

Still another object of the present invention is to provide a door lock that renters could take along when they move and install the lock at their new apartment.

It is a further object of this invention to provide a door lock device which is simple in design, has a minimum of parts, and would be inexpensive to manufacture.

It is still another object of the present invention is to provide a door lock utilizing a u-bolt and a special strike plate that has a safety catch built into the u-bolt. This keeps the u-bolt in the locked position and prevents the u-bolt from falling off.

It is an additional object of the present invention is to provide a door lock utilizing a u-bolt and a special strike plate that has a safety catch built into the u-bolt that is very simple and dependable. Gravity will cause the notch of the u-bolt to catch in the special apertures of the strike plate. This keeps the u-bolt in the locked position and prevents the u-bolt from falling off.

It is a further object of this invention to provide a door lock device which would be inexpensive to manufacture, thus, could be sold to consumers for a relatively low price making the lock affordable to almost anyone.

It is a further object of this invention to provide a door lock device that utilizes a "u-shaped element" that could be manufactured using a variety of different materials and different manufacturing techniques.

It is a further object of this invention to provide a door lock device that utilizes a U-shaped element that has a coating that provides a cushion.

It is a further object of this invention to provide a door lock device that utilizes a U-shaped element that has a means for keeping the U-shaped element in a locked position built into the U-shaped element.

BRIEF DESCRIPTION OF THE DRAWINGS

In order that the manner in which the above and other objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying annexed drawings wherein.

Figure 1:
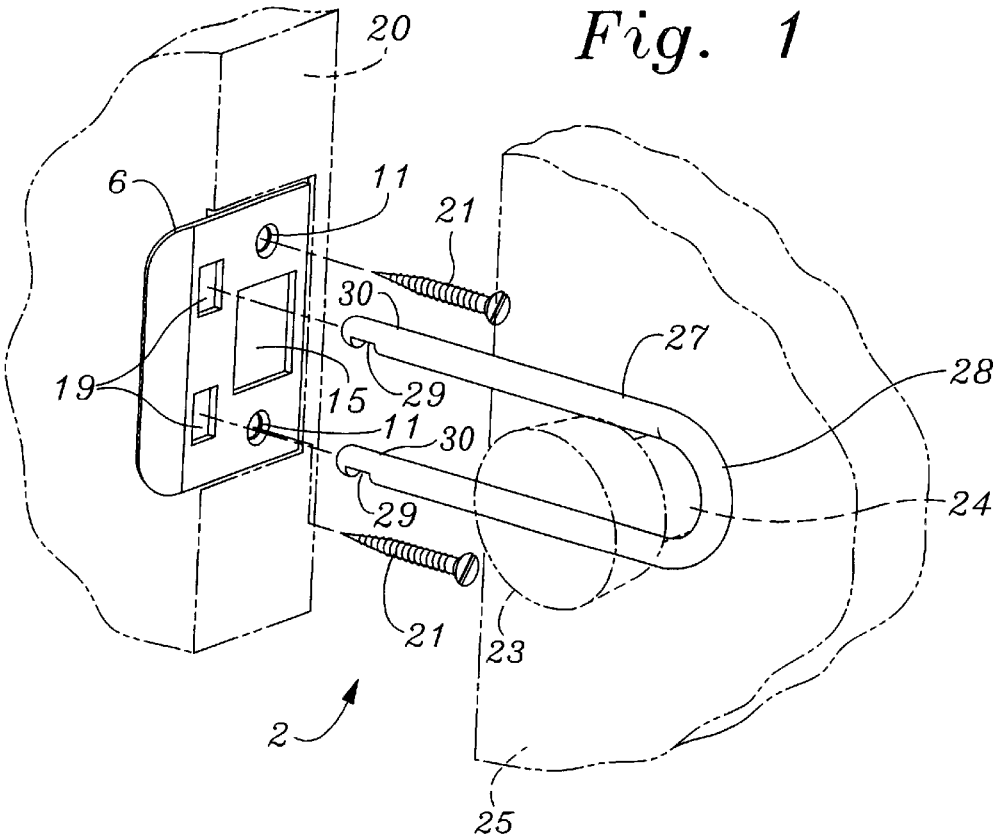
FIG. 1 is a drawing showing the of the u-bolt striker lock positioned over a door knob along with the companion striker plate showing how the striker plate would be mounted on a door jamb.

The objects and advantages of the invention will become apparent when the drawings are studied in conjunction with reading the following description and the claims.

DESCRIPTION OF THE PREFERRED EMBODIMENTS

In keeping with the requirements of Patent Laws there is described herein below the best mode of the invention that is currently known to the applicants. For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

With reference now to the drawings, and in particular, to FIGS. 1–6 thereof, the preferred embodiment of the new and improved door locking device embodying the principles and concepts of the present invention and generally designated by the reference number 6 will be described.

FIG. 1 shows an exploded view of the new door u-bar lock with striker plate shown generally at 2. The custom striker plate 6 has two screw holes 11, a striker plate latch hole 15 and two u-bar arm holes 19. The custom striker plate 6 would be mounted on a door jamb 20 by removing an existing striker plate and then installing the custom striker plate in the same spot by using the same screws 21 from the original striker plate. Most door lock manufacturers have standard size striker plates. Of course, screws could be included with the new striker plate if so desired. If slightly longer screws were included with custom striker plate 6 they could be screwed into the existing holes without much extra effort and would provide extra strength to hold the custom striker plate onto the door jamb 20. The door knob assembly includes a door knob 23, a shank 24 and a tumbler assembly (not shown). The tumbler assembly would have a bolt (not shown) that would be lodged in the bolt aperture 15 when the door 25 is in a closed position. The door knob assembly would also have a door knob on the opposite side of door 25 (not shown.)

The u-bolt 27 of the locking device is "u" shaped with a contour 28 located on one end and two arms extending toward arm ends 30. The u-bolt is designed and manufactured so that the distance between the arms is larger than the shank 24 and smaller than the diameter of the door knob 23. The u-bolt 27 has notches 29 near the arm ends 30.

The u-bolt in general could be made of various metals such as steel or brass or bronze. The u-bolt could also be made of other materials such as a high strength plastic alloy. The u-bolt made of plastic could then be manufactured by an injection molding process which would make the u-bolt very inexpensive to manufacture when compared to making the bolt of metal. There are some plastic alloys that are as strong and rugged as steel. The U-bolt would pop out of the injection mold with the bend 28 and the notches 29 molded into the device.

A u-bolt made of steel or other metal would generally be very rugged and strong. One way to make the u-bolt would be from a rod or bar stock, cutting it and bending it to shape and then grinding the notches 29. The u-bold could be painted or coated with various materials. Another possible manufacturing method for the u-bolt 27 could using metal casting. A high strength bronze alloy might be used as the metal and the U-bolt 27 would have the contour 28 and the notches 29 cast into the device.

Figure 2:
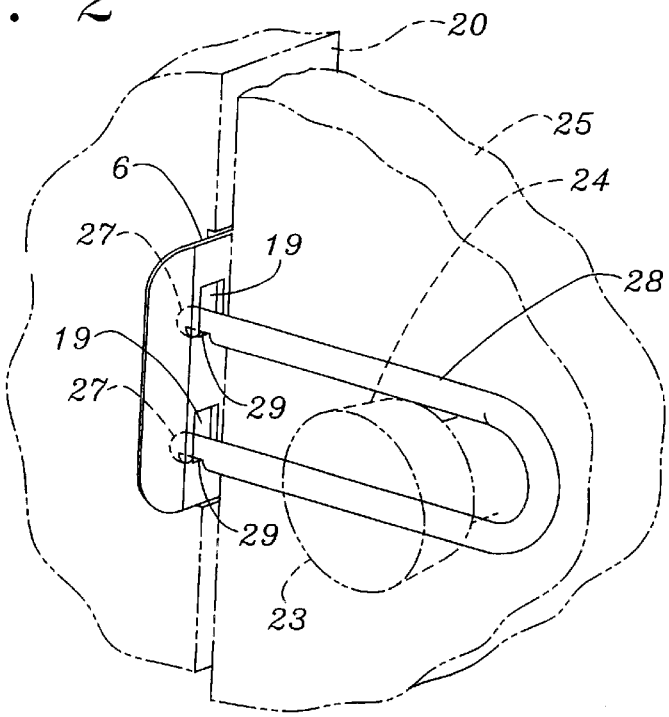
FIG. 2 is a drawing showing the of the u-bolt striker lock positioned over a door knob along with the companion striker plate mounted on a door jamb. The door is closed and the u-bolt has been inserted into the special striker plate openings. This shows the device in the locked position.

FIG. 2 shows the new door locking device with the u-bolt in the "locked" position. The custom striker plate 6 is mounted onto the door jamb 20. The contoured end 28 of the u-bolt is positioned around the shank 24 of the door knob assembly. The two arms 30 of the u-bolt are positioned into the u-bar apertures 19. In this locked position it should be obvious that device should provide a simple rugged locking device with broad appeal. This drawing shows that if the u-bar did manage to move in a direction away from the door jam 20 and toward the door knob 23, the notches 29 in the bolt would keep the u-bolt 27 from slipping out of the apertures 19 and keep the device in the locked position.

Figure 3:
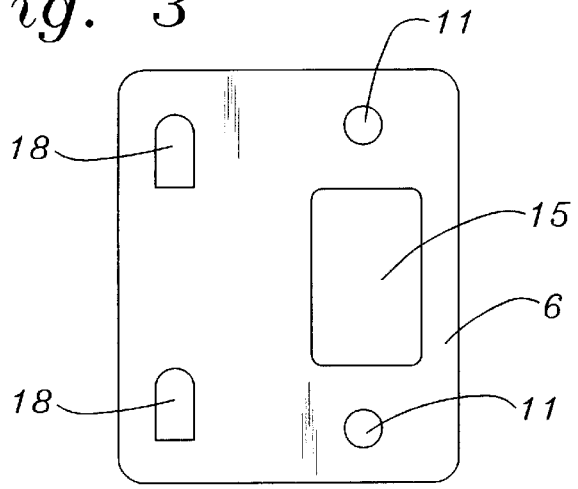
FIG. 3 is a front view of one version of the special striker plate showing openings for the u-bolt as well as for standard screw holes and the door latch.

FIG. 3 is a front view of an alternate design custom striker plate 17 with the bolt aperture 15 the screw apertures 11 and the special u-bolt apertures 18. The u-bolt apertures 18 have a contoured top and a flat bottom. To install the custom striker plate 17, the existing striker plate that is mounted on the door jamb is removed and the new custom striker plate 17 is installed in the same spot as the old striker plate. The custom striker plate 17 is designed to fit in the same notch that an existing striker had been mounted. The custom striker plate 17 The existing striker plate screws can be used to mount the custom striker plate in the existing screw holes. Most lock manufacturing brands have similar design and size striker plates which generally have dimensions of 2½ inches high and 2¼ inches wide. The distance between the mounting screw holes on most striker plates is generally 1¾ inches between centers.

Figure 4:
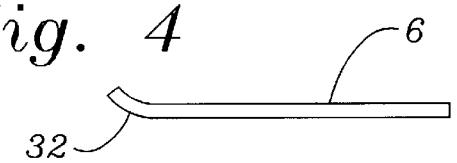
FIG. 4 a edge view of one version of the special striker plate showing a contoured lip on the leading edge of the striker plate.

FIG. 4 is a end view of a custom striker plate 6 showing a lip 32 on the inside edge of the striker plate 6.

Figure 5:
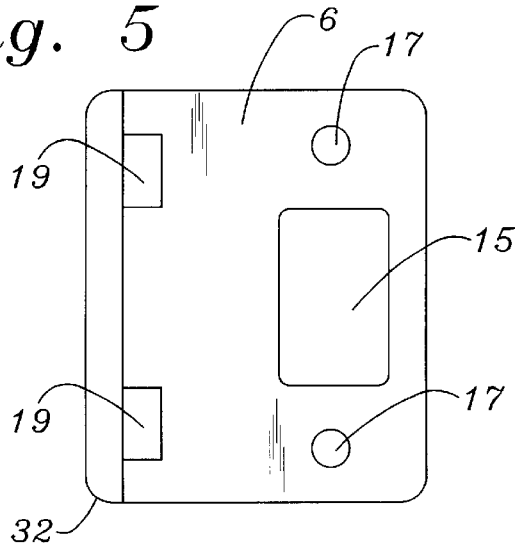
FIG. 5 is a front view of a second version of the special striker plate showing openings for the u-bolt as well as the openings for standard screw holes and the opening for the door latch. This version has the leading edge contour lip shown also.

FIG. 5 is a front view of the custom striker plate 6 with the bolt aperture 15 the screw apertures 11 and the special u-bolt apertures 19 and also showing the lip 32 in the inside edge of the striker plate.

Figure 6:
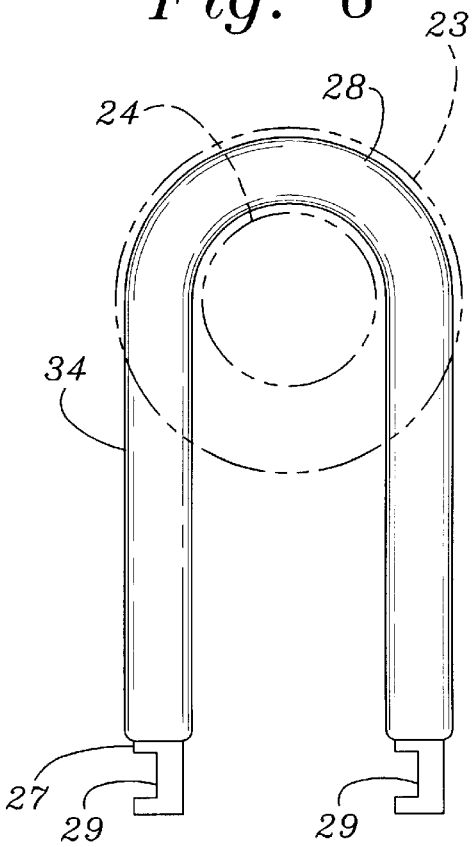
FIG. 6 is a side view of an alternate embodiment of the special the u-bolt showing the special notches that will interact with the special striker plate and also shows a special rubber coating which functions as a bumper cushion and sound dampening feature.

FIG. 6 is a side view of the custom u-bolt 27 showing the contoured end 28 and the special notches 29. A rubber coating 34 on the arms of the u-bolt function as a bumper and cushion if the door is ever opened when the u-bolt is in the "locked position." FIG. 2 shows the U-bolt 27 in the locked position and if the rubber coating 34 shown in FIG. 6 were included on that U-bolt, the door 25 would be cushioned by the coating 34 if the door were opened. The rubber coating will also prevent any "clanging sounds" when the U-bolt is stored on the door knob when the device is in an "unlocked" position. A wide variety of rubber or cushioning type coatings could be applied to a u-bolt.

It should be very clear from the drawings and the above description that this door locking device is a very simple and effective device that will prevent unauthorized passage or forcible entries into a room if this invention is used properly. It is also very apparent that this invention will provide a door locking device that could be easily added to a door that has no lock or a door that already has a lock thereby giving extra security and preventing that door from being opened. It is very evident that what is provided is a door lock that is easy to understand and easy to operate and operates without a key. Additionally, the device provides a door lock that could be quickly placed into the locked position in the case of an emergency and also could be quickly removed from the locked position in the case of an emergency.

This clearly provides a door locking device that is durable and reliable rugged. It would be rather difficult to break the parts during an attempted forced entry. Additionally, this device that would even prevent an intruder with a master key from gaining unauthorized entry through the door and also would create a sound that could be heard if a forced entry is attempted; thereby alerting the person inside the room.

Another very positive feature of this door locking device is that it can be installed easily by almost anyone and would require no special tools for installation. All that would be required would be a screwdriver. And, the lock installation would not structurally alter the door or door jam when installed. Therefore renters would not need special permission to install the device, and they could take the lock along when they move and install the lock at their new apartment.

Another attractive aspect of this door locking device is that it is simple in design, has a minimum of parts, and would be inexpensive to manufacture. Therefore, the lock could be sold to consumers for a relatively low price, making the lock affordable to almost anyone. And, as pointed out, the lock could be manufactured using a variety of different materials and different manufacturing techniques and have coatings if so desired.

This invention having been described in its presently contemplated best mode, it is clear that it is susceptible to numerous, variations, modifications, modes and embodiments within the ability of those skilled in the art and without departing from the true spirit and scope of the novel concepts or principles of this invention. Also, it is to be understood that the phraseology and terminology employed herein are for the purpose of description and should not be regarded as limiting. It should be understood that the preferred embodiment has been shown and described and that all changes and modifications that come within the spirit of the invention are desired to be protected. The invention is capable of other embodiments and of being practiced and carried out in various ways. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention. Accordingly, the scope of the invention is defined by the scope of the following claims.

What is claimed as new and desired to be secured by United States Letters Patent is:

1. A door locking apparatus for use on a door and an associated door jamb, said door locking apparatus having a custom strike plate and a U-shaped element; said U-shaped element having two arm portions; said door jamb having said strike plate mounted there on; said door having a door knob assembly attached to said door, said door knob assembly having a shank and a door knob on the inside side of said door, said door locking apparatus comprising:

a strike plate that can be securely fastened to a door jamb, said strike plate having apertures configured so that screws can be utilized to fasten said strike plate to said door jamb; said strike plate having an aperture so that a bolt of said door knob assembly can be placed therein in order to hold said door in a closed position; said strike plate having an extended section extending outwardly from said door jamb; said extended section of said strike plate having two arm receiving apertures thereon, said two arm receiving apertures configured so that said two arm portions of said U-shaped element can be placed therein;

a U-shaped element having a U-shaped section configured to partially encircle said shank portion of said door knob assembly between said door knob and said door; said U-shaped element having two arm portions extending in a generally horizontal direction;

said strike plate and said U-shaped element configured so that when said door is closed and said U-shaped element partially encircles said shank of said door knob assembly, and said two arm portions of said U-shaped element are inserted into said two arm receiving apertures of said strike plate, said door locking apparatus is in a locked position, and said door is in a locked condition;

said two arm portions of said U-shaped element having notches thereon, said notches configured so that gravitational forces on said arm portions of said U-shaped element will cause said arm portions to catch on said two arm receiving apertures on said strike plate in order to prevent said U-shaped element from inadvertently slipping out of said arm apertures of said strike plate;

thereby keeping said door locking apparatus in a locked position, and keeping said door locked.

2. The door locking apparatus of claim 1 wherein said U-shaped element is made of metal.

3. The door locking apparatus of claim 1 wherein said U-shaped element is made of steel.

4. The door locking apparatus of claim 1 wherein said U-shaped element is made of plastic.

5. The door locking apparatus of claim 1 wherein said striker plate is made of metal.

6. The door locking apparatus of claim 1 wherein said striker plate is made of brass.

7. The door locking apparatus of claim 1 wherein said striker plate is made of steel.

8. The door locking apparatus of claim 1 wherein said U-shaped element has a coating thereon.

9. The door locking apparatus of claim 1 wherein said U-shaped element is made of metal and said U-shaped element has a coating thereon.

10. The door locking apparatus of claim 1 wherein said arm receiving apertures of said striker plate are substantially square shaped or substantially rectangular shaped.

11. The door locking apparatus of claim 1 wherein said arm receiving apertures of said striker plate have a shape that is substantially a flat bottom and a substantially contoured top.

12. The door locking apparatus of claim 1 wherein said striker plate is sized to fit in a standard sized strike plate recess in a door jam.

13. The door locking apparatus of claim 1 wherein said striker plate has screw apertures that are sized to fit in a standard sized notch in a door jamb and said screw apertures are spaced to match existing standard screw holes in said door jam.

14. The door locking apparatus of claim 1 further including screws for mounting said striker plate to said door jam.

15. The door locking apparatus of claim 1 further including two or more screws for mounting said striker plate to said door jam, said two or more screws being longer that standard striker plate screws;

thereby providing a stronger striker plate attachment means.

16. A door locking apparatus for use on a door and an associated door jamb, said door locking apparatus having a custom strike plate and a U-shaped element; said U-shaped element having two arm portions; said door jamb having said strike plate mounted there on; said door having a door knob assembly attached to said door, said door knob assembly having a shank and a door knob on the inside of said door, said door locking apparatus comprising:

a strike plate that can be securely fastened to a door jamb, said strike plate having apertures configured so that screws can be utilized to fasten said strike plate to said door jamb; said strike plate having an aperture so that a bolt of said door knob assembly can be placed therein in order to hold said door in a closed position; said strike plate having an extended section extending outwardly from said door jamb; said extended section of said strike plate having two arm receiving apertures thereon, said two arm receiving apertures configured so that said two arm portions of said U-shaped element can be placed therein;

a U-shaped element having a U-shaped section configured to partially encircle said shank portion of said door knob assembly between said door knob and said door; said U-shaped element having two arm portions extending in a generally horizontal direction;

said strike plate and said U-shaped element configured so that when said door is closed and said U-shaped element partially encircles said shank of said door knob assembly, and said two arm portions of said U-shaped element are inserted into said two arm receiving apertures of said strike plate, said door locking apparatus is in a locked position, and said door is in a locked condition;

said two arm portions of said U-shaped element having a built in means for keeping said U-shaped element in a locked position;

thereby preventing said U-shaped element from inadvertently slipping out of said arm apertures of said strike plate;

thereby keeping said door locking apparatus in a locked position, and keeping said door locked.

17. The door locking apparatus of claim 16 wherein said built in means for keeping said U-shaped element in a locked position comprises notches on said two arm portions of said U-shaped element; said notches being configured to prevent said U-shaped element from inadvertently slipping out of said arm apertures of said strike plate;

thereby keeping said door locking apparatus in a locked position, and keeping said door locked.

18. The door locking apparatus of claim 18 wherein said U-shaped element is made of steel.

19. The door locking apparatus of claim 18 wherein said U-shaped element is made of made of metal and said U-shaped element has a coating thereon.

20. A door locking apparatus for use on a door and an associated door jamb, said door locking apparatus having a custom strike plate and a U-shaped element; said U-shaped element having two arm portions; said door jamb having said strike plate mounted there on; said door having a door knob assembly attached to said door, said door knob assembly having a shank and a door knob on the inside side of said door; said door locking apparatus comprising:

a metal strike plate that can be securely fastened to a door jamb, said strike plate having apertures configured so that screws can be utilized to fasten said strike plate to said door jamb; said strike plate having an aperture so that a bolt of said door knob assembly can be placed therein in order to hold said door in a closed position; said strike plate having an extended section extending outwardly from said door jamb; said extended section of said strike plate having two arm receiving apertures thereon, said two arm receiving apertures configured so that said two arm portions of said U-shaped element can be placed therein;

a metal U-shaped element having a U-shaped section configured to partially encircle said shank portion of said door knob assembly between said door knob and said door; said U-shaped element having two arm portions extending in a generally horizontal direction;

said strike plate and said U-shaped element configured so that when said door is closed and said U-shaped element partially encircles said shank of said door knob assembly, and said two arm portions of said U-shaped element are inserted into said two arm receiving apertures of said strike plate, said door locking apparatus is in a locked position, and said door is in a locked condition locked;

said two arm portions of said U-shaped element having notches thereon, said notches configured so that gravitational forces on said arm portions of said U-shaped element will cause said arm portions to catch on said two arm receiving apertures on said strike plate in order to prevent said U-shaped element from inadvertently slipping out of said arm apertures of said strike plate;

thereby keeping said door locking apparatus in a locked position, and keeping said door locked.

* * * * *